US005252148A

United States Patent [19]

Shigeta et al.

[11] Patent Number: 5,252,148

[45] Date of Patent: Oct. 12, 1993

[54] SOFT MAGNETIC ALLOY, METHOD FOR MAKING, MAGNETIC CORE, MAGNETIC SHIELD AND COMPRESSED POWDER CORE USING THE SAME

[75] Inventors: Masao Shigeta, Narashino; Asako Kajita, Abiko; Ippo Hirai; Tsutomu Choh, both of Yachiyo, all of Japan

[73] Assignee: TDK Corporation, Tokyo, Japan

[21] Appl. No.: 926,389

[22] Filed: Aug. 10, 1992

Related U.S. Application Data

[63] Continuation of Ser. No. 528,827, May 25, 1990, abandoned.

[30] Foreign Application Priority Data

| | | | |
|---|---|---|---|
| May 27, 1989 | [JP] | Japan | 1-133540 |
| Apr. 13, 1990 | [JP] | Japan | 2-98905 |
| Apr. 13, 1990 | [JP] | Japan | 2-98906 |
| May 11, 1990 | [JP] | Japan | 2-122299 |
| May 11, 1990 | [JP] | Japan | 2-122300 |

[51] Int. Cl.[5] ..... H01F 1/04

[52] U.S. Cl. ..... 148/307; 148/305; 420/34; 420/45; 420/49; 420/50; 420/51; 420/58; 420/60; 420/64; 420/73; 420/74; 420/76; 420/90; 420/91; 420/97; 420/98; 420/104; 420/112; 420/117; 420/118; 420/119; 420/120; 420/121

[58] Field of Search ..... 148/305, 306, 307, 310; 420/34, 43, 45, 49, 50, 51, 54, 58, 60, 64, 70, 73, 76, 74, 90, 91, 92, 93, 97, 98, 104, 112, 117, 118, 119, 120, 121

[56] References Cited

U.S. PATENT DOCUMENTS 4,985,089 1/1991 Yoshizawa et al. ..... 148/303

FOREIGN PATENT DOCUMENTS 0096551 12/1983 European Pat. Off. .
0271657 6/1988 European Pat. Off. .
0374847 6/1990 European Pat. Off. ..... 148/307
3001889 7/1980 Fed. Rep. of Germany .
3835986 5/1989 Fed. Rep. of Germany .

OTHER PUBLICATIONS

Japanese Patent Application Kokai No. 1(1989)-142049, Jun. 1989 (No translation-English Abstract.)

*Primary Examiner*—John P. Sheehan
*Attorney, Agent, or Firm*—Oblon, Spivak, McClelland, Maier & Neustadt

[57] ABSTRACT

A soft magnetic alloy having a composition of general formula:

$$(Fe_{1-a}Ni_a)_{100-x-y-z-p-q}Cu_xSi_yB_zCr_pM^1{}_q \quad (I)$$

wherein $M^1$ is V or Mn or a mixture of V and Mn, $0 \leqq a \leqq 0.5$, $0.1 \leqq x \leqq 5$, $6 \leqq y \leqq 20$, $6 \leqq z \leqq 20$, $15 \leqq y+z \leqq 30$, $0.5 \leqq p \leqq 10$, and $0.5 \leqq q \leqq 10$ and possessing a fine crystalline phase is suitable as a core, especially a wound core and a compressed powder core.

7 Claims, 4 Drawing Sheets

SOFT MAGNETIC ALLOY, METHOD FOR MAKING, MAGNETIC CORE, MAGNETIC SHIELD AND COMPRESSED POWDER CORE USING THE SAME

This application is a continuation of application Ser. No. 07/528,827, filed on May 25, 1990, now abandoned.

This invention relates to soft magnetic alloys, and more particularly, to iron base soft magnetic alloys having high corrosion resistance and low magnetostriction and a method for making such a soft magnetic alloy. It also relates to magnetic cores, magnetic shield compositions, and compressed powder cores.

BACKGROUND OF THE INVENTION

Severer requirements have been continuously imposed on soft magnetic materials. Basic requirements are high saturation magnetization, high magnetic permeability, and low core losses. To meet these requirements, the soft magnetic materials should satisfy the conditions that (1) their magnetostriction constant $\lambda s$ is as low as $\pm 5\times 10^{-6}$, and (2) their crystalline magnetic anisotropy is low. If these two conditions were not met, there would be soft magnetic materials which have no satisfactory basic properties or are not useful at all in some applications.

More particularly, in an application where stresses are applied at all times during operation as in the case of magnetic heads, during manufacture of magnetic cores, typically compressed powder cores, or in an application where stresses are applied to cores at all times, the useful soft magnetic material should have a zero or negative magnetostriction constant $\lambda s$, especially of the order of from 0 to $-5\times 10^{-6}$.

Known soft magnetic materials of the iron base alloy type include pure iron, silicon steel, Sendust alloys, and amorphous iron base alloys, all of which are characterized by a high saturation magnetic flux density. Among these soft magnetic materials, amorphous iron base alloys have become widespread because of their high saturation magnetic flux density and low iron losses.

However, amorphous iron base alloys can find only limited applications because of their high magnetostriction constant. The amorphous iron base alloys have made little progress in those applications where stresses are applied, for example, magnetic heads, smoothing choke coils, compressed powder cores, and magnetic shields because there arises an essentially serious problem that magnetic properties are substantially deteriorated.

Among the amorphous alloys, however, there are known amorphous cobalt base alloys having a magnetostriction constant of approximately zero. Unfortunately, the cobalt base alloys have a low saturation magnetic flux density and are expensive. They are thus used in only those applications where the material cost is not a predominant factor, for example, such as magnetic heads.

One approach to solve the problems associated with amorphous alloys is an iron-base soft magnetic alloy having a fine crystalline phase as proposed in EPA Publication No. 0 271 657 A2 (Hitachi Metals Co., Ltd., published 22.06.88). This soft magnetic alloy is prepared by first forming an amorphous alloy of the corresponding composition, and then heat treating the alloy so as to develop a fine crystalline phase. This alloy improves over the conventional amorphous iron base alloys. A substantial reduction in saturation magnetostriction constant is especially desirable. Nevertheless, this alloy is still unsatisfactory in some aspects. In particular, it is impossible to manufacture an alloy having a zero or negative magnetostriction constant. Therefore, the alloy cannot be practically used in those applications where stresses are applied, for example, such as magnetic heads. The above-referred publication describes an example in which a magnetostriction constant approaches zero at a boron (B) content of about 5 atom % (e.g., $Fe_{74}Cu_1Nb_3Si_{17}B_5$ alloy). However, it is generally well known that alloys having a boron content of about 5 atom % are difficult to render amorphous. In addition, the alloy of the above-referred publication is quite low in corrosion resistance which is of basic importance for metallic materials.

Alloys having a fine crystalline phase are prepared by heat treating an amorphous alloy as described above. In turn, the amorphous alloy is prepared by rapid quenching from a melt by a single or double chill roll method. The single and double chill roll methods involves injecting a molten alloy against the surface of a chill roll through a nozzle, thereby rapidly quenching the alloy for forming a thin ribbon or piece of amorphous alloy. Rapid quenching is desirably carried out in a non-oxidizing atmosphere in order to prevent oxidation of the melt.

It is, however, difficult and expensive to strictly maintain a non-oxidizing atmosphere. Therefore, the atmosphere generally used in rapid quenching contains some oxygen so that the melt is somewhat oxidized near the nozzle tip. The oxide of the melt forms a scale which deposits on the nozzle tip. The nozzle is thus blocked as the melt injection is continued, requiring replacement of the nozzle or in some cases, causing breakage of the rapid quenching apparatus. The nozzle blockage becomes a serious problem for mass production requiring continuous injection of an alloy melt for an extended period of time. A highly viscous alloy melt tends to promote nozzle blockage because the melt injection becomes more difficult due to a reduction of nozzle diameter by oxide deposition. The nozzle blockage is detrimental to mass production and cost.

Choke coils, for example, common mode choke coils and normal mode choke coils as noise filters are utilized in smoothing an output of a switching power supply. A choke coil is arranged to allow for passage of AC current flow overlapping DC current flow. The core of the choke coil should have such magnetic properties that its magnetic permeability changes little as the intensity of an applied magnetic field varies, that is, constant magnetic permeability. If squareness ratio (residual magnetic flux density/saturation magnetic flux density, Br/Bs) is high, application of intense pulsative noises causes the operating point to shift to the point of residual magnetization Br, at which magnetic permeability is markedly inferior to that at the operating point originally located at the origin of the B-H loop. Therefore, constant magnetic permeability can be accomplished by increasing the unsaturation area in the B-H hysteresis diagram, or evening out the B-H loop.

One exemplary magnetic core material having high magnetic permeability is an iron base magnetic alloy having fine crystalline particles as disclosed in Japanese Patent Application Kokai No. 142049/1989. This iron base magnetic alloy is prepared by heat treating an amorphous alloy so as to develop fine crystalline particles. According to the disclosure of Kokai, the iron base magnetic alloy is improved in core loss, variation of core loss with time, and permeability and other magnetic properties. Especially noted, it has a saturation magnetostriction constant as low as within $\pm 5\times 10^{-6}$. Since this iron base magnetic alloy has high squareness property irrespective of a low saturation magnetostriction constant, it is formed into a core of a common mode choke coil by heat treating the alloy in a magnetic field applied in a direction perpendicular to the magnetic path (the direction of a magnetic flux extending when used as the core), thereby slanting the B-H curve or loop for achieving a low squareness ratio and constant permeability. In order that the magnetic field be applied in a direction perpendicular to the magnetic path, the entire core must be placed in a uniform magnetic field. A large size magnet is then necessary. An extremely larger size magnet is necessary in order to apply a uniform magnetic field over a plurality of cores at the same time. This impractical scale-up results in reduced productivity. Thus the heat treatment in a magnetic field is not amenable to mass production of cores at low cost. Further, although the heat treatment in a magnetic field applied in a direction perpendicular to the magnetic path results in a core having a low squareness ratio, its magnetic permeability can change during use because the applied magnetic field is offset 90° from the magnetization direction of an actual common mode choke coil.

SUMMARY OF THE INVENTION

A first object of the present invention is to provide a soft magnetic alloy having a fine crystalline phase, markedly improved corrosion resistance, and an extremely low magnetostriction constant, especially of approximately zero or in the range of from zero to a negative value, and a method for preparing the soft magnetic alloy as well as a magnetic core, a magnetic shield composition, and a dust core using the same.

A second object of the invention is to provide a soft magnetic alloy having a fine crystalline phase, markedly improved corrosion resistance, and an extremely low magnetostriction constant, especially of approximately zero or in the range of from zero to a negative value, which can be efficiently mass produced at a low cost, and a method for preparing the same.

A third object of the invention is to provide a soft magnetic alloy having sufficiently high and constant magnetic permeability for use as choke coil cores, and a method for preparing the soft magnetic alloy as well as a magnetic core having improved magnetic properties which is manufactured from the soft magnetic alloy in an efficient manner.

According to the present invention, the first object is attained by a soft magnetic alloy having a fine crystalline phase and a composition of the following general formula (I) or (II).

$$(Fe_{1-a}Ni_a)_{100-x-y-z-p-q}Cu_xSi_yB_zCr_pM^1{}_q \quad (I)$$

In formula (I), $M^1$ is V or Mn or a mixture of V and Mn, and $0\leqq a\leqq 0.5$, $0.1\leqq x\leqq 5$, $6\leqq y\leqq 20$, $6\leqq z\leqq 20$, $15\leqq y+z\leqq 30$, $0.5\leqq p\leqq 10$, and $0.5\leqq q\leqq 10$.

$$(Fe_{1-a}Ni_a)_{100-x-y-z-p-q-r}Cu_xSi_yB_zCr_pM^1{}_qM^2{}_r \quad (II)$$

In formula (II), $M^1$ is V or Mn or a mixture of V and Mn, $M^2$ is at least one element selected from the group consisting of Ti, Zr, Hf, Nb, Ta, Mo, and W, and $0\leqq a\leqq 0.5$, $0.1\leqq x\leqq 5$, $6\leqq y\leqq 20$, $6\leqq z\leqq 20$, $15\leqq y+z\leqq 30$, $0.5\leqq p\leqq 10$, $0.5\leqq q\leqq 10$, and $0\leqq r\leqq 10$.

The second object is attained by a soft magnetic alloy having a fine crystalline phase and a composition of the following general formula (III).

$$(Fe_{1-a}Ni_a)_{100-x-y-z-p-q-r}Cu_xSi_yB_zCr_pV_qMn_r \quad (III)$$

In formula (III), letters a, x, y, z, p, q, and r are in the following ranges: $0\leqq a\leqq 0.5$, $0.1\leqq x\leqq 5$, $6\leqq y\leqq 20$, $6\leqq z\leqq 20$, $15\leqq y+z\leqq 30$, $0.5\leqq p\leqq 10$, $0.5\leqq q\leqq 2.5$, $0\leqq r$, and $3\leqq p+q+r\leqq 12.5$ The third object is attained by a soft magnetic alloy having a fine crystalline phase and a composition of the following general formula (IV).

$$(Fe_{1-a}Ni_a)_{100-x-y-z-p-q-r}Cu_xSi_yB_zCr_pV_qMn_r \quad (IV)$$

In formula (IV), letters a, x, y, z, p, q, and r are in the following ranges: $0\leqq a\leqq 0.5$, $0.1\leqq x\leqq 5$, $6\leqq y\leqq 20$, $6\leqq z\leqq 20$, $15\leqq y+z\leqq 30$, $0.2\leqq p$, $0.2\leqq q$, $0\leqq r$, and $0.4\leqq p+q+r<3$.

The soft magnetic alloy of the present invention has a basic composition of

FeCuCr(V,Mn)SiB.

The soft magnetic alloys having the compositions of formulae (I) to (IV) according to the present invention may be prepared by first forming an amorphous alloy of any one of the compositions, and then heat treating the alloy so as to develop a fine crystalline phase.

In the compositions of formulae (I) to (IV), Cr and V and/or Mn are introduced into soft magnetic alloys having a fine crystalline phase so that magnetostriction is minimized, especially to the range of from zero to a negative value and corrosion resistance is improved.

Because of minimized magnetostriction, the present soft magnetic alloy is well suitable for use as a magnetic shield composition. The magnetic shield composition is prepared by mixing a soft magnetic alloy powder and a binder. Even when the soft magnetic alloy undergoes stresses during milling of the alloy powder and the binder, during shrinkage of the binder upon curing, or during use as a magnetic shield, the magnetic shield composition or material experiences little loss of magnetic properties and magnetically shielding properties.

The soft magnetic alloy of the invention is also suitable for various cores of, for example, common mode choke coils, audio band transformers, earth leakage transformers or O phase current transformers, and current transformers. The alloy is applicable as gapped cores and cut cores, for example, with the benefit that no beat is generated. When a resin coating is provided on such a gapped core or cut core, the magnetic properties of the core are not deteriorated by shrinkage of the resin upon curing as previously described. Of course, the alloy having minimized magnetostriction is suitable as magnetic heads.

The soft magnetic alloy having the composition of formula (III) in which the maximum V content is limited to 2.5 atom % has the advantage that an alloy melt has a low viscosity and is less prone to oxidation upon injection through a nozzle for rapid quenching, thus preventing the nozzle from being clogged.

The improvement in corrosion resistance of a soft magnetic alloy by inclusion of Cr, V, and Mn is based on the formation of a passivated film on the alloy surface. However, it is impossible to form a passivated film on an alloy melt. Making a series of experiments for the purpose of improving the oxidation resistance of an alloy melt, we have found that the oxidation resistance can be improved by controlling the V content to at most 2.5 atom %.

The soft magnetic alloy having the composition of formula (IV) which contains at least 0.2 atom % of each of Cr and V has the advantage of high magnetic permeability due to formation of a fine crystalline phase. The alloy is fully resistant against corrosion. The alloy has a low squareness ratio because the total content of Cr, V and Mn is less than 3 atom %. This soft magnetic alloy is suitable as cores of common mode choke coils.

Due to the restricted total content of Cr, V and Mn of less than 3 atom %, the alloy has a relatively high magnetostriction constant λs. Then stress application can readily reduce the gradient of a B-H loop to achieve a low squareness ratio, eliminating a need for a heat treatment in a magnetic field applied in a direction perpendicular to the magnetic path. By forming a coating for applying stresses, for example, an insulating coating on the surface of a thin ribbon or particles of a soft magnetic alloy, there can be produced a core having a constant and high permeability suitable as common mode choke coils.

In the prior art, iron base amorphous soft magnetic alloys are known as having increased magnetostriction. Since their magnetostriction is too high, the iron base amorphous soft magnetic alloys provide magnetic-mechanical resonance, undergoing a wide variation of effective permeability μe in the practical frequency range between 100 kHz and 1 MHz.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Figure 1:
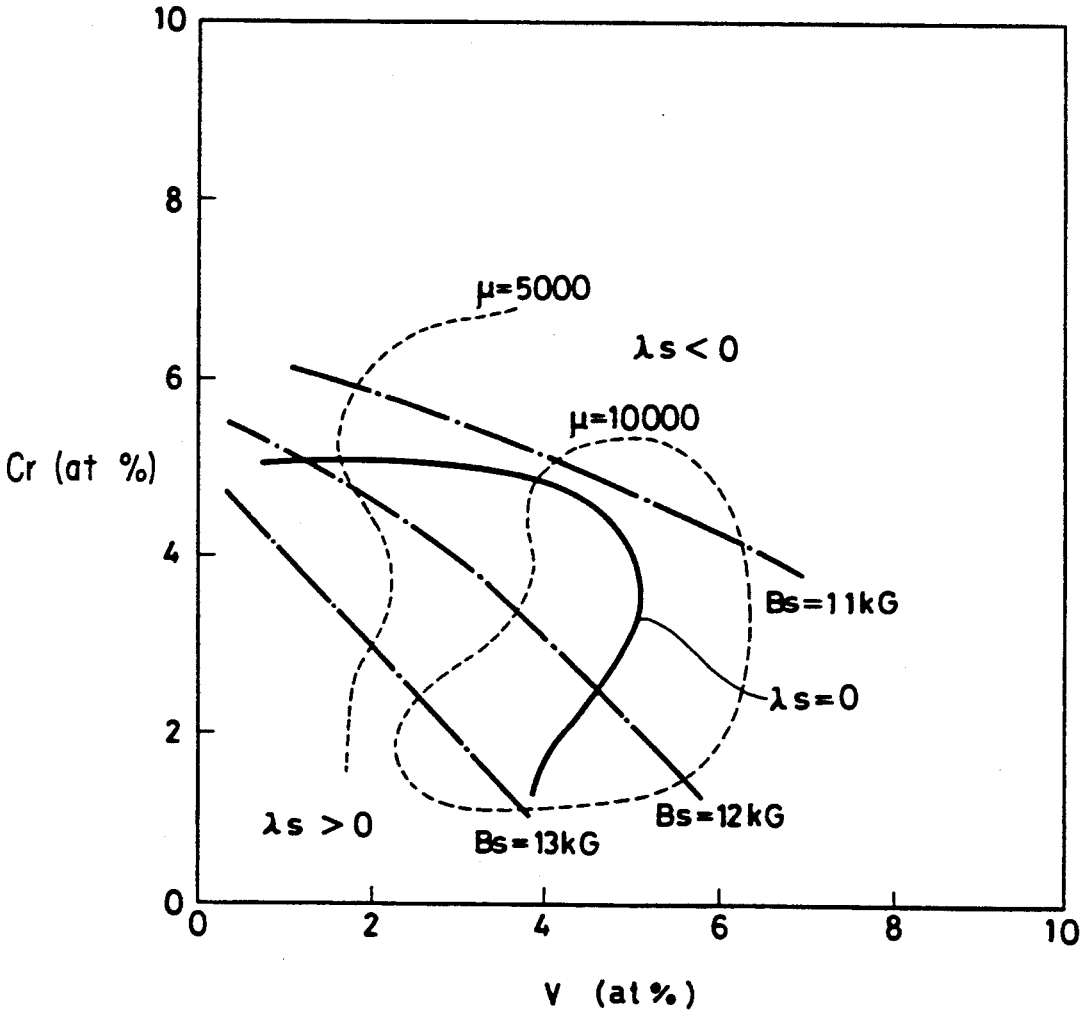
FIG. 1 is a diagram showing curves of magnetostriction constant λs, saturation magnetic flux density Bs, and effective permeability μe relative to Cr and V contents in the soft magnetic alloy composition of the invention.

The soft magnetic alloy according to the first aspect of the invention has a fine crystalline phase and a composition of general formula (I).

$$(Fe_{1-a}Ni_a)_{100-x-y-z-p-q}Cu_xSi_yB_zCr_pM^1_q \quad (I)$$

In formula (I), $M^1$ is V or Mn or a mixture of V and Mn, letter a is $0 \leqq a \leqq 0.5$, and letters x, y, z, p, and q represent atomic percents in the following ranges:

$0.1 \leqq x \leqq 5$,
$6 \leqq y \leqq 20$,
$6 \leqq z \leqq 20$,
$15 \leqq y+z \leqq 30$,
$0.5 \leqq p \leqq 10$, and
$0.5 \leqq q \leqq 10$.

The soft magnetic alloy becomes more ductile and maleable when it contains nickel (Ni). Then the alloy can be powdered by means of a media agitating mill (to be described later) into particles of flat shape suitable for magnetic shields. Inclusion of nickel improves corrosion resistance and facilitates ribbon manufacture. However, saturation magnetic flux density is reduced if the nickel proportion (a) exceeds 0.5. Preferably, $0 \leqq a \leqq 0.1$.

Copper (Cu) is an essential element to create a fine crystalline phase through a heat treatment (to be described later). The copper content (x) is in the range of from 0.1 to 5 atom %, because a lesser copper content impedes formation of a fine crystalline phase and an excess copper content impedes formation of a thin ribbon by the rapid quenching of an alloy melt. Further, with x outside the range, magnetic properties, especially permeability are lowered, failing to achieve a satisfactory effective permeability for use as common mode choke coil wound cores. The preferred range of x is $0.3 \leqq x \leqq 2$, especially $0.3 \leqq x \leqq 1$.

Silicon (Si) and boron (B) are included for rendering the alloy amorphous. The silicon and boron contents are in the ranges of $6 \leqq y \leqq 20$, $6 \leqq z \leqq 20$, and $15 \leqq y+z \leqq 30$ so that an alloy having a fine crystalline phase can be obtained by rapidly quenching an alloy melt of a corresponding composition by a single roll method or a water atomizing method, to thereby form an amorphous alloy, and then heat treating the amorphous alloy to create fine crystalline grains. If y, z, and y+z are outside the above-defined ranges, it becomes difficult to form an amorphous alloy. Magnetostriction is increased if the B content (z) exceeds the range. The preferred ranges of y and z are $8 \leqq y \leqq 20$, $6 \leqq z \leqq 16$ (especially $7 \leqq z \leqq 16$), and $20 \leqq y+z \leqq 28$.

In addition to Si and B, the alloy may contain another vitrifying element such as C, Ge, P, Ga, Sb, In, Be, and As. These vitrifying elements help an amorphous alloy form along with Si and B and act to adjust Curie temperature and magnetostriction. These vitrifying elements may be contained in such amounts to replace at most 30% of the total content of Si and B, that is, y+z. Among the additional vitrifying elements, P is preferred for improving corrosion resistance and rendering amorphous.

Chromium (Cr) and $M^1$ are included for the purposes of reducing magnetostriction and improving corrosion resistance. $M^1$ is also effective in expanding the optimum range of temperature available during the heat treatment for crystallization. The Cr content (p) and $M^1$ content (q) are in the ranges of $0.5 \leqq p \leqq 10$ and $0.5 \leqq q \leqq 10$. Lesser contents often result in impeded formation of a fine crystalline phase, a negative magnetostriction constant of an increased magnitude, and a reduction in corrosion resistance. Contents p and q in excess of the above-defined ranges invite difficulty to form an amorphous alloy and a reduced saturation magnetic flux density.

The ranges of p and q are discussed in detail. With $0.5 \leqq p$ and $0.5 \leqq q$, the soft magnetic alloy can be controlled to have a magnetostriction constant λs within the range of $\pm 5 \times 10^{-6}$. With $0.5 \leqq p$ and $1.0 \leqq q$, the magnetostriction constant λs can have a value of at most $+4 \times 10^{-6}$. With $1.0 \leqq p$ and $1.0 \leqq q$, the magnetostriction constant λs can have a value of at most $+3 \times 10^{-6}$.

Further, under the conditions of $0.5 \leqq p$ and $0.5 \leqq q$, if p and q are in the ranges of $3 \leqq p$ or $2 \leqq q$, preferably $3.5 \leqq p$ or $2.5 \leqq q$, the magnetostriction constant $\lambda s$ can range from $-5 \times 10^{-6}$ to $+0.5 \times 10^{-6}$, especially from $-5 \times 10^{-6}$ to 0, more especially from $-5 \times 10^{-6}$ to less than 0. In this case, an effective permeability of at least 5,000 at 100 kHz and 2 mOe is available. In some cases, an effective permeability of from 10,000 to 20,000 or higher at 100 kHz is available. Further, a saturation magnetic flux density of at least 10 kG, especially from 10 to 15 kG is available.

The preferred range of p and q is $p+q \leqq 15$.

In addition to the above-mentioned elements, the soft magnetic alloy of the invention may contain any one or more elements selected from Al, platinum group elements, Sc, Y, rare earth elements, Au, Zn, Sn, and Re. The total content of the additional elements, if any, should be up to 10 atom % in the composition of the above-defined formula.

The soft magnetic alloy according to the second aspect of the invention has a fine crystalline phase and a composition of general formula (II).

$$(Fe_{1-a}Ni_a)_{100-x-y-z-p-q-r}Cu_x \cdot Si_yB_zCr_pM^1_qM^2_r \quad \text{(II)}$$

In formula (II), $M^1$ is V or Mn or a mixture of V and Mn, $M^2$ is at least one element selected from the group consisting of Ti, Zr, Hf, Nb, Ta, Mo, and W, letter a is $0 \leqq a \leqq 0.5$, and letters x, y, z, p, q, and r represent atomic percents in the following ranges:

$0.1 \leqq x \leqq 5$, $6 \leqq y \leqq 20$, $6 \leqq z \leqq 20$, $15 \leqq y+z \leqq 30$, $0.5 \leqq p \leqq 10$, $0.5 \leqq q \leqq 10$, and $0 \leqq r \leqq 10$.

The soft magnetic alloy of the composition represented by formula (II) is based on an Fe-Cu-Si-B-$M^2$ system having Cr and $M^1$ added thereto for the purposes of reducing magnetostriction and improving corrosion resistance.

In the soft magnetic alloy of the composition represented by formula (II), the reason of limitation of a, x, y, z, y+z, p, and q representing the atomic contents of respective elements, substitutable elements for the elements, and additionally available elements are substantially the same as previously described for formula (I). The preferred range of p, q, and r is $p+q+r \leqq 15$.

The soft magnetic alloy of the invention preferably contains 0.1 to 95% by volume, more preferably 50 to 90% of a fine crystalline phase. A soft magnetic alloy containing a major proportion of a fine crystalline phase shows especially improved magnetic properties. The remainder of the alloy is substantially composed of an amorphous phase.

For better magnetic properties, the fine crystalline phase preferably consists of fine grains having a grain size of up to 1,000 Å, more preferably up to 500 Å, especially up to 200 Å, most preferably 50 to 200 Å. The term grain size is an average of maximum diameters of crystal grains which can be measured by means of a transmission electron microscope.

The soft magnetic alloy of the invention may contain N, O, S and other incidental impurities in such amounts as not to adversely affect the magnetic properties of the alloy.

Now, the method for preparing the soft magnetic alloy according to the invention is described.

The soft magnetic alloy is generally prepared by rapidly quenching a melt of a suitable alloy composition by a single or double chill roll method, to thereby form a ribbon of amorphous alloy. Alternatively, an amorphous alloy powder is formed by a water atomizing method. Then the amorphous alloy is heat treated so that a fine crystalline phase is created.

In the case of rapid quenching also known as melt spinning, a ribbon of amorphous alloy is generally produced to a thickness of 5 to 50 μm, preferably 15 to 25 μm. It is rather difficult to produce an amorphous alloy ribbon of a thickness outside this range.

A ribbon or powder of amorphous alloy prepared by a melt spinning or water atomizing method is preferably heat treated in vacuum or in an inert gas atmosphere of nitrogen, hydrogen, or argon although the heat treatment may also be carried out in air. The temperature and time of the heat treatment vary with the composition, shape, and dimension of a particular alloy, but preferably range from 450° C. to 700° C. and from 5 minutes to 24 hours. Satisfactory magnetic properties, especially high permeability are available substantially throughout this temperature range. Only a lesser amount of fine crystalline phase would be created at a heat treating temperature lower than the range, while coarse grains would grow at a higher temperature outside the range. In either case, there is available no soft magnetic powder having high magnetic properties. Further, a heat treating time below the range is too short to allow uniform distribution of heat throughout the alloy. Coarse grains would grow if the treating time is too long. In either case, there is available no soft magnetic alloy having high magnetic properties. The more preferred temperature and time of the heat treatment range from 500° C. to 650° C. and from 5 minutes to 6 hours. The heat treatment may be carried out in a magnetic field.

The soft magnetic alloy of the invention can find a variety of applications. Some preferred applications are described in detail.

Wound Core

The wound core is a winding of the soft magnetic alloy of the invention.

The shape and dimension of a wound core are not critical. The shape may be selected for a particular purpose from various well-known shapes including toroidal and race-track shapes. The core may be dimensioned so as to have an outer diameter of about 3 to about 1,000 mm, an inner diameter of about 2 to about 500 mm, and a height of about 1 to about 100 mm.

The wound core is preferably provided with interlayer insulation when pressure resistance is required. The interlayer insulation may be achieved by any desired method, for example, by interposing an organic film such as polyimide and polyester between layers or interposing a coating inorganic powder such as alumina and magnesia between layers.

The wound core may be prepared by any desired method, but preferably by rapidly quenching a melt of a suitable alloy composition to form a ribbon of amorphous alloy, winding the ribbon, and then heat treating the winding as previously described so as to create a fine crystalline phase. As previously described, the heat treatment is preferably carried out in an inert atmosphere although an oxidizing atmosphere such as air is acceptable. In the latter case, a thin oxide film is formed on the surface of an amorphous alloy ribbon during the heat treatment, providing interlayer insulation. This is advantageous as cores for common mode choke coils used in a high frequency region because improvements in frequency response are expectable.

To control the magnetic properties of a wound core, it is preferably heat treated in a magnetic field. When a wound core is heat treated in a magnetic field applied in the magnetic flux direction of the core (or in the longitudinal direction of the ribbon), the resulting wound core shows a high squareness ratio. When heat treatment is carried out in a magnetic field applied perpendicular to the magnetic flux direction of the core (or in the transverse direction of the ribbon), there is obtained a wound core having constant permeability.

The wound core manufactured from a soft magnetic ribbon in this way may be further processed into a cut core or gapped core by dipping the core in a thermosetting resin such as an epoxy resin, thermosetting the coating, and then cutting or forming a gap.

Dust Core

The dust core or compressed powder core to which the invention is applicable is a compact of a powdered soft magnetic alloy according to the invention.

The dust core may have a shape and dimensions similar to those of the above-mentioned wound core.

The dust core is generally prepared by rapidly quenching a melt of a suitable alloy composition by a melt spinning method, forming an amorphous alloy in ribbon form. The amorphous alloy ribbon is then heat treated for embrittlement purposes. The heat treatment is preferably carried out at about 300° C. to about 450° C. for about 10 minutes to about 10 hours. After the heat treatment for embrittlement, the ribbon is finely divided into particles with an average size of about 10 to 3,000 μm, especially 50 to 3,000 μm by means of a vibratory ball mill. The amorphous alloy particles are then subjected to an insulating treatment. The insulating treatment is not critical, although a coating of an inorganic material such as water glass is preferably formed on the surface of each particle for insulation. As in the case of the wound core, it is also possible to carry out the heat treatment for embrittlement in an oxidizing atmosphere to form an insulating film on amorphous particles. Such particles may be further subjected to an insulating treatment as described above.

The amorphous alloy particles having undergone insulating treatment are then press molded into a compact while any one or more of inorganic and organic lubricants may be added if necessary. Press molding is generally carried out at a temperature of about 400° to 550° C. and a pressure of about 5 to 20 t/cm$^2$ for about 0.1 sec. to about one hour. The compact is then heat treated under sufficient conditions to create a fine crystalline phase among the amorphous alloy particles as previously described, obtaining a dust core comprising a powder of the soft magnetic alloy of the invention. The powder occupies about 50 to 100% by volume, preferably 75 to 95% by volume of the dust core.

The wound core and dust core manufactured as described above are suitable for use in choke coils for smoothing an output of a switching power supply.

Magnetic Shield

The magnetic shield composition of the invention is a mixture of a powdered soft magnetic alloy of the invention and a binder. The soft magnetic powder is preferably comprised of flat particles having an average thickness of up to 1 μm, especially 0.01 to 1 μm. Particles with an average thickness of less than 0.01 μm are less desirable because of less dispersion in the binder, a lowering of magnetic properties such as permeability, and poor shielding properties. Better results are obtained with particles having an average thickness of 0.01 to 0.6 μm. It is to be noted that the average thickness is measurable by means of a scanning electron microscope for analysis.

The flat particles may have an aspect ratio of from 10 to 3,000, preferably from 10 to 500. The aspect ratio is the average diameter divided by the average thickness of flat particles. Particles with an aspect ratio of less than 10 would be greatly affected by a diamagnetic field and insufficient in magnetic properties such as permeability and shielding properties. Flat particles having an average thickness of the above-mentioned range, but an aspect ratio in excess of 3,000 are susceptible to rupture during milling with the binder because their average diameter is too large.

The average particle diameter is a weight mean particle diameter D50. It is the diameter at which the integrated value reaches 50% of the weight of the overall soft magnetic powder when the soft magnetic powder is divided into fractions of flat particles and the weight of flat particle fractions having successively increasing diameters is integrated from the smallest diameter fraction. The particle diameter is a measurement by a light scattering particle counter. More particularly, light scattering particle size analysis is carried out by causing particles to circulate, directing light from a light source such as a laser or halogen lamp, and measuring Fraunhofer diffraction or the scattering angle of Mie scattering, thereby determining the distribution of particle size. The detail of particle size measurement is described in "Funtai To Kogyo" (Powder and Industry), Vol. 19, No. 7 (1987). D50 can be determined from the particle size distribution obtained from the particle counter.

The flat particles used in the magnetic shield preferably have a D50 of 5 to 30 μm.

The flat particles desirable have a larger elongation of at least 1.2 when the magnetic shield is required to be directional. Provided that a flat particle has a length or major diameter a and a breadth or minor diameter b along a major surface configuration, the elongation used herein is a ratio of length to breadth, a/b. If a magnetic field source is directional, a magnetic coating composition is cured while an orienting magnetic field is applied in the same direction. Then the permeability in the direction is improved, providing an increased magnetic shield effect in the desired direction. Better results are obtained with an elongation a/b in the range of from 1.2 to 5. Such an elongation is readily achievable with the use of a media agitating mill. The length and breadth of particles can be measured by a transmission electron microscope for analysis.

The soft magnetic powder of such flat particles preferably has the following magnetic properties for improved magnetic shield effect. The powder preferably has a maximum magnetic permeability μm of 20 to 80, more preferably 25 to 60 in a DC magnetic field and a coercive force Hc of 1 to 20 Oe, more preferably 1 to 14

Oe. A soft magnetic powder of flat particles generally exhibits magnetic properties, especially a coercive force approximately 100 to 1,000 times that of a ribbon alloy of the same composition.

The soft magnetic powder described above is preferably prepared by a method involving a first step of rapidly quenching a melt of a suitable alloy composition to form an amorphous alloy powder, a second step of flattening the amorphous alloy powder into flat amorphous alloy particles, and a third step of heat treating the flat amorphous alloy powder so as to create a fine crystalline phase.

The first step preferably uses a water atomizing method for rapid quenching. The amorphous alloy powder resulting from a water atomizing method is herein designated a water atomized powder.

Figure 3:
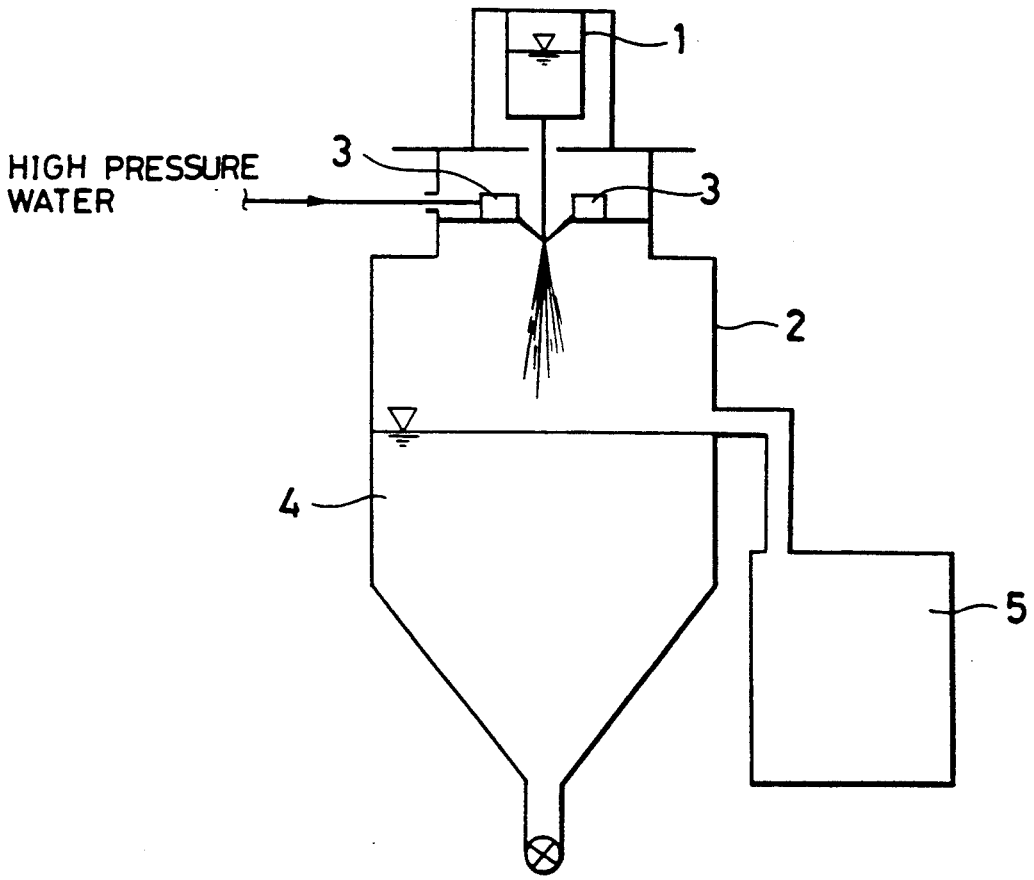
FIG. 3 is a schematic view of a water atomizing apparatus.

Referring to FIG. 3, a water atomizing apparatus is schematically illustrated as comprising an alloy melting furnace 1, an atomizing tank 2 below the furnace 1, a water injecting nozzle 3 between the furnace 1 and the tank 2, a water reservoir 4 defined by a lower portion of the atomizing tank 2, and a drain tank 5. A raw material alloy is converted into a melt in the melting furnace 1, for example, by induction heating. The alloy melt flows down into the atomizing tank 2 through a nozzle at the bottom of the melting furnace 1. High pressure water is injected against the flow of alloy melt through the nozzle 3, thereby atomizing and solidifying the melt into particles. The atomizing tank 2 is of an inert gas atmosphere in order to prevent oxidation of the resulting powder. Then the powder is collected from the water reservoir 4 and the drain tank 5 and dried, obtaining a water atomized powder. The water atomizing method permits an alloy melt to be directly converted into a powder without passing a ribbon form.

The water atomizing method can produce a water atomized powder of any desired bulk density and dimensions by suitably controlling the flow rate of the melt, the pressure, injection rate, injection speed, and injection direction of high pressure water through the atomizing nozzle, and the shape of the atomizing nozzle. Preferred parameters for the water atomizing method are described. The flow rate of the melt is in the range of from about 10 to about 1,000 gram/sec. The high pressure water is injected through the nozzle under a pressure of about 10 to about 1,000 atmospheres at a flow rate of about 50 to about 100 liter/sec. The cooling rate is about 100° to about 1,000° C./sec. The raw material alloy may have the composition of the end soft magnetic alloy powder, that is, a composition of the above-defined formula.

To eventually produce a soft magnetic powder having the above-mentioned desired properties, the water atomized powder should preferably consist of amorphous alloy particles having a weight average particle size D50 of 5 to 30 μm, more preferably 7 to 20 μm. Smaller particles are rather difficult to flatten whereas larger particles are rather less amorphous.

The water atomized powder preferably has a bulk density of at least 2 g/cm$^3$, more preferably 2.1 to 5 g/cm$^3$, most preferably 2.5 to 4.5 g/cm$^3$.

It is to be noted that bulk density is correlated to shape regularity of alloy particles. More particularly, the particle shape is more irregular with a lower bulk density and less irregular with a higher bulk density. A water atomized powder having a bulk density in excess of the above-defined range is less amorphous so that the subsequent flattening by a media agitating mill results in less amorphous particles. A water atomized powder having a bulk density below the above-defined range is a mass of alloy particles of more irregular shape, which are irregularly ruptured upon flattening by a media agitating mill, resulting in flat particles whose dimensions, shape and particle size distribution are outside the desired ranges.

A water atomized powder having a bulk density within the above-defined range consists of alloy particles of generally spherical shape. When they are flattened by means of a media agitating mill in the second step, the rolling and shearing forces generated by the mill act effectively on them to produce flat particles of the desired shape and dimensions.

The method for producing a soft magnetic powder of such desired nature is not limited to the water atomizing method. It is also possible to produce flat amorphous alloy particles by melt spinning a ribbon by a conventional single chill roll method, crushing the ribbon, and then flattening the fragments in a medium agitating mill.

The second step is to flatten amorphous alloy particles. Preferably a media agitating mill is used for flattening purposes. The media agitating mill is an agitator including a pin mill, bead mill, and agitator ball mill, one example being shown in Japanese Patent Application Kokai No. 259739/1986.

Figure 4:
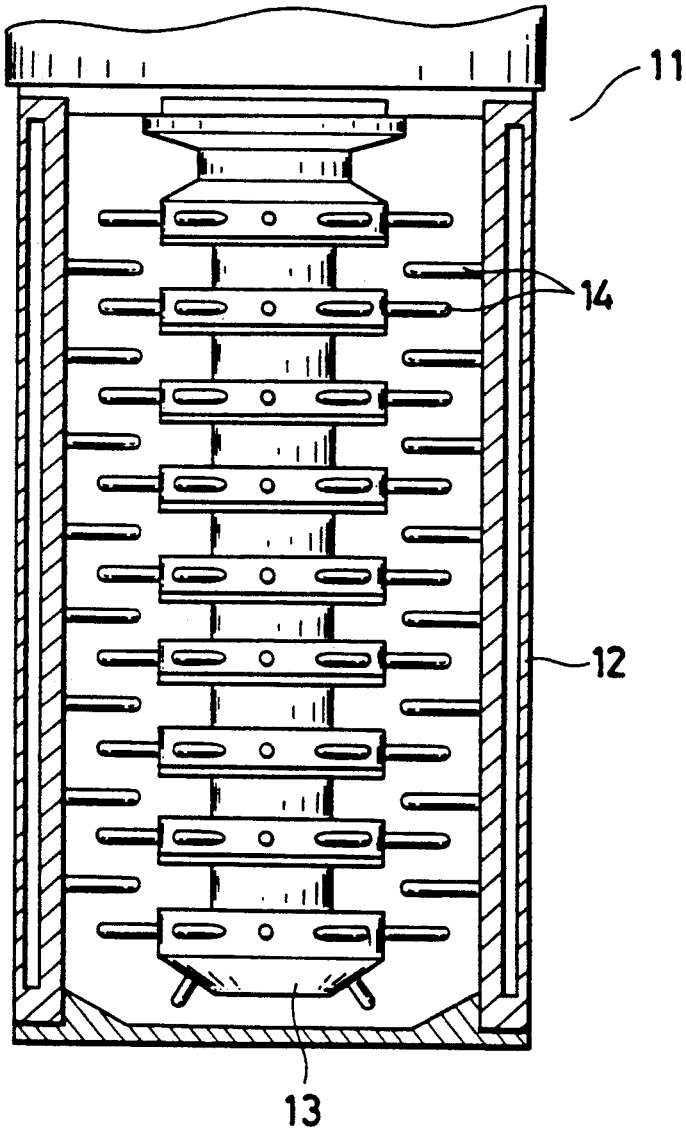
FIG. 4 is a fragmental cross-sectional view of a media agitating mill.

Referring to FIG. 4, the configuration of a typical media agitating mill 11 is shown in fragmental axial cross section. The mill 11 includes a cylindrical housing 12 having a plurality of radially inwardly extending rods 14 anchored to the inner wall thereof and a rotor 13 within the housing having a plurality of radially outwardly extending rods 14 anchored to the rotor. The space between the inner wall of the housing 12 and the outer surface of the rotor 13 is filled with a medium in the form of beads and a powder to be milled. When the housing 12 and the rotor 13 are rotated at a high relative speed, the rods 14 act to agitate the beads which in turn, apply rolling and shearing forces to the powder.

The amorphous alloy particles of the water atomized powder are flattened by such rolling and shearing forces exerted by the mill, resulting in particles of flat shape suitable as the magnetic shield material.

The preferred conditions for rolling and shearing in a media agitating mill include a bead diameter of 1 to 5 mm, a bead filling of 20 to 80%, a circumferential speed of 1 to 20 m/sec. at the tip of the rods 14 extending from the rotor 13.

It should be appreciated that conventional milling means other than the media agitating mill, for example, stamp mills, vibratory mills, and attritors fail to produce flat alloy particles of the desired shape.

The third step is to heat treat the flat alloy particles of the desired shape and dimensions resulting from the media agitating mill. The heat treatment creates a fine crystalline phase in the flat alloy particles. This heat treatment may be carried out in the same manner as previously described for the same purpose.

The thus obtained soft magnetic powder is blended with a binder to form a magnetic shield composition in which flat particles are dispersed in the binder.

The magnetic shield composition preferably has a maximum permeability μm of at least 50, more preferably at least 100, especially 150 to 400, most preferably 180 to 350 in a DC magnetic field and a coercive force Hc of 2 to 20 Oe, more preferably 2 to 15 Oe as calculated on the assumption that the composition consists of 100% of the powder. Such excellent magnetic properties are readily obtained because the number of milling and working steps is reduced so that minimal working strains are introduced. This leads to an increased maximum permeability μm, offering a satisfactory magnetic shield effect. A coercive force Hc of up to 20 Oe also contributes to a satisfactory magnetic shield effect.

The soft magnetic powder preferably occupies 60 to 95% by weight of the magnetic shield composition. If the packing is less than 60% by weight, the magnetic shield effect is drastically reduced. If the packing is more than 95% by weight, the magnetic shield composition is reduced in strength because the binder is too short to firmly bind soft magnetic particles together. Better magnetic shield effect and higher strength are obtained with a packing of 70 to 90% by weight.

The binder used herein is not particularly limited. It may be selected from conventional well-known binders including thermoplastic resins, thermosetting resins, and radiation curable resins.

The magnetic shield composition may contain a curing agent, dispersant, stabilizer, coupler or any other desired additives in addition to the soft magnetic powder and the binder.

The magnetic shield composition is generally used by molding it into a desired shape, or diluting it with a suitable solvent to form a coating composition and applying it as a coating, and then heat curing the shape or coating, if necessary. Curing is generally carried out in an oven at a temperature of 50° to 80° C. for about 6 to about 100 hours.

When it is desired to shape the magnetic shield composition into a film or thin band which is suitable as a magnetic shield, the film or thin band preferably has a thickness of 5 to 200 μm. Since the magnetic shield composition of the invention has magnetic properties as previously defined, a film as thin as 5 μm can have a magnetic shielding effect. For shielding against a magnetic field having an intensity at which the shield composition is not magnetically saturated, the magnetic shielding effect is increased no longer by increasing the thickness of a film beyond 200 μm. The maximum thickness of 200 μm is also determined for economy.

When the magnetic shield composition is molded into a desired shape or coated, a directional magnetic shield can be produced by applying an orienting magnetic field or effecting mechanical orientation. Particularly when the magnetic shield composition is formed into a plate or film having a thickness within the above-defined range, the plate or film shows a high magnetic shielding effect against a magnetic field parallel to the major surface thereof.

When used in the magnetic shield composition, the soft magnetic powder may be formed with a conductive coating of Cu, Ni or a similar metal.

The magnetic shield composition is applicable as magnetic shields for use in various electrical equipment such as speakers and cathode ray tubes (CRT).

Magnetic Head

The soft magnetic alloy of the invention is adapted for use as magnetic heads having a stack of thin plates, thin film type magnetic heads, and metal-in-gap type magnetic heads.

The soft magnetic alloy according to the third aspect of the invention has a fine crystalline phase and a composition in atomic ratio of general formula (III).

$$(Fe_{1-a}Ni_a)_{100-x-y-z-p-q-r}Cu_xSi_yB_zCr_pV_qMn_r \quad \text{(III)}$$

In formula (III), letter a is $0 \leqq a \leqq 0.5$, letters x, y, z, p, q, and r represent atomic percents in the following ranges, $0.1 \leqq x \leqq 5$,
$6 \leqq y \leqq 20$,
$6 \leqq z \leqq 20$,
$15 \leqq y+z \leqq 30$,
$0.5 \leqq p \leqq 10$,
$0.5 \leqq q \leqq 2.5$,
$0 \leqq r$, and
$3 \leqq p+q+r \leqq 12.5$.

Formula (III) is analogous to formula (I) except that V and Mn are copresent and their contents q and r are defined to somewhat different ranges.

As previously described, chromium (Cr), vanadium (V) and manganese (Mn) are included for the purposes of reducing magnetostriction and improving corrosion resistance. V and Mn are also effective in expanding the optimum range of temperature available during the heat treatment for crystallization. The Cr content (p), V content (q), and Mn content (r) are in the ranges of $0.5 \leqq p \leqq 10$, $0.5 \leqq q \leqq 2.5$, $0 \leqq r$, and $3 \leqq p+q+r \leqq 12.5$. These ranges are defined for achieving optimum permeability. With (p+q+r) in excess of the above-defined range, it becomes difficult to form an amorphous alloy and saturation magnetic flux density is reduced. The vanadium content (q) is limited to the narrow range of $0.5 \leqq q \leqq 2.5$ because the corresponding alloy melt becomes more resistant against oxidation and less viscous.

The preferred ranges for p, q, and r are $1 \leqq p \leqq 3$,
$0.5 \leqq q \leqq 1$, and
$0 \leqq r \leqq 0.5$.

The soft magnetic alloy of this embodiment has an effective permeability of at least 5,000 at 100 kHz. In some cases, an effective permeability of from 10,000 to 20,000 or higher at 100 kHz is available. Further, a saturation magnetic flux density of at least 10 kG is available.

The soft magnetic alloy of this embodiment preferably contains 0.1 to 95%, more preferably 50 to 90% of a fine crystalline phase. A soft magnetic alloy containing a major proportion of a fine crystalline phase shows a low magnetostriction and a high effective permeability. The crystallinity can be controlled by a heat treatment.

The remaining parameters of the soft magnetic alloy of this embodiment including composition, crystal structure, shape, dimensions, magnetic and other properties are the same as previously described for formulae (I) and (II).

The preparation of such a soft magnetic alloy is also the same as previously described in the first and second embodiments. The composition of formula (III) is especially suitable in spinning through a nozzle which is prone to clogging, for example, a nozzle in which the lips defining an injection slit have a transverse distance of about 0.1 to 0.5 mm. Rapid quenching may be carried out in air although an inert gas such as argon gas is preferably blown toward the nozzle outlet. Preferably rapid quenching is carried out in an inert gas atmosphere such as argon gas, more preferably in vacuum.

The soft magnetic alloy of this embodiment is used in the same applications as previously described in the first and second embodiments.

The soft magnetic alloy according to the fourth aspect of the invention has a fine crystalline phase and a composition in atomic ratio of general formula (IV).

$$(Fe_{1-a}Ni_a)_{100-x-y-z-p-q-r}Cu_xSi_yB_zCr_pV_qMn_r \quad (IV)$$

In formula (III), letter a is $0 \leqq a \leqq 0.5$, letters x, y, z, p, q, and r represent atomic percents in the following ranges, $0.1 \leqq x \leqq 5$, $6 \leqq y \leqq 20$, $6 \leqq z \leqq 20$, $15 \leqq y+z \leqq 30$, $0.2 \leqq p$, $0.2 \leqq q$, $0 \leqq r$, and $0.4 \leqq p+q+r < 3$.

Formula (IV) is analogous to formula (III) except for the ranges of the Cr, V and Mn contents (p, q and r).

As previously described, chromium (Cr), vanadium (V) and manganese (Mn) are included for the purposes of reducing magnetostriction and improving corrosion resistance. V and Mn are also effective in expanding the optimum range of temperature available during the heat treatment for crystallization. The Cr content (p), V content (q), and Mn content (r) are in the ranges of $0.2 \leqq p$, $0.2 \leqq q$, $0 \leqq r$, and $0.4 \leqq p+q+r < 3$. A Cr or V content (p or q) of less than 0.2 atom % results in impeded formation of a fine crystalline phase, low corrosion resistance, and increased magnetostriction. The total content of Cr, V, and Mn, that is, (p+q+r) is defined for optimum magnetostriction. The more preferred range is $1.5 \leqq p+q+r \leqq 2.5$.

The soft magnetic alloy of the composition of formula (IV) has a magnetostriction constant $\lambda s$ of $6 \times 10^{-6}$ to $20 \times 10^{-6}$, especially $7 \times 10^{-6}$ to $16 \times 10^{-6}$. It has a squareness ratio (Br/Bs) of 50 to 90%, especially 50 to 70%. It has an effective permeability of at least 5,000 at 100 kHz. In some cases, an effective permeability of from 10,000 to 20,000 or higher at 100 kHz is available. Further, a saturation magnetic flux density of at least 10 kG is available.

The soft magnetic alloy of this embodiment preferably contains 0.1 to 95%, more preferably 0.1 to 50% of a fine crystalline phase. Within such a crystallinity, $\lambda s$ can be at least $6 \times 10^{-6}$ and Br can be reduced. The crystallinity can be controlled by a heat treatment.

The remaining parameters of the soft magnetic alloy of this embodiment including composition, crystal structure, shape, dimensions, magnetic and other properties are the same as previously described for formulae (I) and (II).

The preparation of such a soft magnetic alloy is also substantially the same as previously described in the first and second embodiments. A ribbon of amorphous alloy prepared by melt spinning may be heat treated in air, vacuum, or inert gas such as nitrogen and argon. The temperature and time of the heat treatment vary with the composition, shape, and dimension of a particular alloy, but preferably range from 450° C. to 600° C. and from 5 minutes to 24 hours. Satisfactory magnetic properties, especially high permeability are available substantially throughout this temperature range. The more preferred temperature and time of the heat treatment range from 450° C. to 550° C. and from 5 minutes to 6 hours. The heat treatment may be carried out in a magnetic field.

The soft magnetic alloy of this embodiment can find a variety of applications and is especially suitable as wound cores and dust cores. Since the general discussion about wound cores and dust cores is the same as previously described, only the difference is described.

Wound Core

The heat treatment for creating a fine crystalline phase is preferably carried out after a ribbon has been wound. More particularly, a ribbon of amorphous alloy is prepared by melt spinning, wound into a race track or any other desired shape, and then heat treated. Since the heat treatment can also serve to remove strain, the heat treatment after winding operation eliminates the possibility that strain be introduced again after strain removal.

A soft magnetic alloy having a constant permeability is achievable by applying stresses to the alloy to even out its B-H loop. Such stress application is preferably carried out by forming a coating on the ribbon surface for applying stresses to the ribbon. The coating used herein is preferably selected from insulating coatings including a coating of a thermosetting resin such as an epoxy resin, a coating of an inorganic material such as water glass, and a coating of an inorganic powder such as alumina and magnesia. The insulating coating is formed on the alloy ribbon before it is wound. Once the ribbon is wound, adjoining turns are in contact with each other, rendering it difficult to apply an insulating coating to the ribbon over the entire surface, leaving insulation defects.

Therefore, an insulating coating is formed on an alloy ribbon, the ribbon is then wound, and the wound ribbon is heat treated. This order requires the insulating coating to be heat resistant. Thus water glass is very suitable as the insulating coating material.

The provision of such an insulating coating is effective to apply stresses and to improve the pressure resistance of a wound core. When the wound core is used as a core of a common mode choke coil operating in a high frequency region, there is available an additional advantage of improved frequency response.

It is also possible and preferable to use an oxide film as the insulating coating. Such an oxide film is preferably formed by carrying out a heat treatment for crystallization in an oxidizing atmosphere.

Since the soft magnetic alloy of the invention has a sufficiently low squareness ratio for use as cores of common mode choke coils, its performance is sufficient for practical purposes without a coating. The heat treatment is preferably carried out in an inert atmosphere although an oxidizing atmosphere such as air is acceptable as previously described.

The wound core generally has a squareness ratio of up to 80%, especially 60 to 80%. The squareness ratio can be reduced to 50% or lower, especially 30% or lower by forming a coating for applying stresses.

Dust Core

The dust core or compressed powder core to which the soft magnetic alloy of this embodiment is applicable may be prepared by any desired method. Preferably, the dust core is prepared by rapidly quenching a melt of a suitable alloy composition by a melt spinning method, forming an amorphous alloy in ribbon form. The amorphous alloy ribbon is then heat treated for embrittlement purposes. The heat treatment is preferably carried out at about 300° C. to about 450° C. for about 10 minutes to about 10 hours. After the heat treatment for embrittlement, the ribbon is finely divided into particles with an average size of about 10 to 3,000 μm, especially 50 to 3,000 μm by means of a vibratory ball mill. The amorphous alloy particles are then subjected to an insulating treatment. An insulating coating is preferably formed on the surface of each particle for insulation. Examples of the insulating coating are described in connection with the wound core, with inorganic materials such as water glass being preferred for heat resistance. It is also possible to carry out the heat treatment for embrittlement in an oxidizing atmosphere to form an insulating or oxide film on amorphous particles. Such particles may be further subjected to an insulating treatment, that is, an insulating coating of water glass may be overlaid on an oxide film.

The amorphous alloy particles having an insulating coating formed thereon are then press molded into a compact while any one or more of inorganic and organic lubricants may be added if necessary. Press molding is generally carried out at a temperature of about 400° to 550° C. and a pressure of about 5 to 20 t/cm$^2$ for about 0.1 sec. to about one hour. Hot pressing at a fine grain formation initiating temperature facilitates the press molding procedure. That is, a high density compact can be readily press molded. Since the soft magnetic alloy is well resistant against corrosion, the powder is stable during pressing at elevated temperatures.

The compact is then heat treated under sufficient conditions to create a fine crystalline phase among the amorphous alloy particles as previously described, obtaining a dust core comprising a powder of the soft magnetic alloy of the invention. The powder occupies about 50 to 100% by volume, preferably 75 to 95% by volume of the dust core.

The cores manufactured as described above are suitable for use in choke coils for smoothing an output of a switching power supply and choke coils for noise filters. The wound cores are especially suitable for common mode choke coils.

EXAMPLE

Examples of the invention are given below by way of illustration and not by way of limitation.

EXAMPLE 1

A starting alloy material having the composition shown in Table 1 was melted and then rapidly quenched into a ribbon of amorphous alloy by a single chill roll method.

The amorphous alloy ribbon was heat treated at 500° to 550° C. for one hour in nitrogen gas to thereby create a fine crystalline phase, obtaining a soft magnetic ribbon sample of 22 μm thick and 3 mm wide. The sample was observed under a transmission electron microscope to find that the sample possessed a fine crystalline phase of grains having an average grain size of up to 1,000 Å.

The sample was measured for a magnetostriction constant λs, an effective permeability μ at 100 kHz and 2 mOe, and saturation magnetic flux density Bs. Corrosion resistance was evaluated. A variation in coercive force Hc by stress application was determined.

The corrosion resistance test was carried out by dipping a sample in 5% sodium chloride water for 24 hours and observing the sample surface. The evaluation criterion is given below.

○: no change
Δ: partial rusting
×: substantial rusting
××: entire rusting

The variation in coercive force Hc was measured by winding a ribbon sample into a toroidal shape having an outer diameter of 14 mm, an inner diameter of 10 mm, and a height of 3 mm, and securing the ends to form a wound core. The coercive force HcO of this wound core was measured. Then stress was applied to the wound core by placing a weight of 500 grams thereon. The coercive force Hcl of the stressed core was measured. A variation in coercive force is calculated as Hcl/HcO.

The results are shown in Table 1.

TABLE 1

| Sample No. | Alloy composition (at %) | λs ($\times 10^{-6}$) | Corrosion resistance | 100 kHz μ | 100 kHz Bs (kG) | Hc variation |
|---|---|---|---|---|---|---|
| 1 | $Cu_{0.6}Cr_4V_5Si_{14}B_{13}Febal.$ | ≃0 | ○ | 15,000 | 11 | 1.0 |
| 2* | $Cu_1Nb_3Si_{14}B_{13}Febal.$ | +6 | XX | 8,000 | 13 | 2.5 |
| 3 | $Cu_{0.5}Cr_4V_5Si_{13}B_{10}Febal.$ | −0.8 | ○ | 17,000 | 11 | 0.9 |
| 4* | $Cu_1Nb_3Si_{13}B_{10}Febal.$ | +4 | XX | 11,000 | 13 | 2.1 |
| 5 | $Cu_{0.5}Cr_4V_5Si_{15}B_{11}Febal.$ | −0.9 | ○ | 13,000 | 11 | 0.9 |
| 6* | $Cu_1Nb_3Si_{15}B_{11}Febal.$ | +1.9 | X | 13,000 | 12 | 1.7 |
| 7 | $Cu_{0.5}Cr_4V_5Si_{14}B_{11}Febal.$ | −1.2 | ○ | 10,500 | 11 | 0.8 |
| 8* | $Cu_1Nb_3Si_{14}B_{11}Febal.$ | +0.6 | X | 4,800 | 12 | 1.4 |
| 9* | $Cu_1Cr_1V_7Ru_2Si_{14}B_8Febal.$ | +1.1 | ○ | 4,000 | 10 | 1.5 |

*comparison

As seen from Table 1, the soft magnetic alloys of the invention containing Cr and V have a low magnetostriction constant λs and high corrosion resistance.

It was found that when each melt of alloys having the compositions:

$Cu_{0.5}Cr_4V_5Si_{20}B_4Fe_{bal}$ and $Cu_1Nb_3Si_{20}B_4Fe_{bal}$ was rapidly quenched by a single chill roll method, it did form neither an amorphous alloy nor a ribbon. The rapidly quenched alloys were heat treated as described above and then measured for coercive force, finding a coercive force in excess of 5 Oe.

EXAMPLE 2

Soft magnetic ribbon samples were prepared by the same procedure as in Example 1 except that alloy melts having the compositions shown in Table 2 were used.

Each sample was observed under a transmission electron microscope to find that the sample possessed a fine crystalline phase of grains having an average grain size of up to 1,000 Å.

The samples were examined for the same properties as in Example 1.

The results are shown in Table 2.

TABLE 2

| Sample No. | Alloy composition (at %) | λ ($\times 10^{-6}$) | 100 kHz μ | 100 kHz Bs (kG) | Corrosion resistance | Hc variation |
|---|---|---|---|---|---|---|
| 11* | $Cu_1Nb_3Si_{20.5}B_5Febal.$ | ≈0 | 4,700 | 11 | X | 1.0 |
| 12* | $Cu_1Cr_3Nb_3Si_{13.5}B_0Febal.$ | +4.8 | 10,000 | 13 | Δ | 2.3 |
| 13 | $Cu_1Cr_3V_4Si_{13.5}B_{10}Febal.$ | ≈0 | 12,000 | 13 | ○ | 1.0 |

*comparison

As seen from Table 2, the soft magnetic alloy of the invention containing both Cr and V has a low magnetostriction constant λs and high corrosion resistance. Inclusion of Nb alone or Nb and Cr could not afford such improvements.

It was found that when a melt of alloy having the composition:

$Cu_1Nb_3Cr_3Si_{20.5}B_5Fe_{bal}$ was rapidly quenched by a single chill roll method, it did form neither an amorphous alloy nor a ribbon. The rapidly quenched alloy was heat treated as described in Example 1 and then measured for coercive force, finding a coercive force in excess of 5 Oe.

EXAMPLE 3

Soft magnetic ribbon samples were prepared by the same procedure as in Example 1 except that alloy melts having the compositions shown in Table 3 were used.

Each sample was observed under a transmission electron microscope to find that the sample possessed a fine crystalline phase of grains having an average grain size of up to 1,000 Å.

The samples were examined for the same properties as in Example 1.

The results are shown in Table 3.

TABLE 3

| Sample No. | Alloy composition (at %) | λ ($\times 10^{-6}$) | 100 kHz μ | 100 kHz Bs (kG) | Corrosion resistance | Hc variation |
|---|---|---|---|---|---|---|
| 21 | $Cu_{0.7}Cr_5V_4Si_{13}B_{10}Febal.$ | −0.4 | 13,000 | 11 | ○ | 0.96 |
| 22 | $Cu_{0.7}Cr_4V_5Si_{0.6}B_{14.4}Febal.$ | ≈0 | 10,000 | 12 | ○ | 1.0 |
| 23 | $Cu_{0.7}Cr_4V_5Si_{13}B_{12.5}Febal.$ | −0.5 | 17,000 | 12 | ○ | 0.93 |
| 24 | $Cu_{0.7}Cr_4Mn_3Si_{13.5}B_{11}Febal.$ | ≈0 | 14,000 | 12 | ○ | 1.0 |

Each melt of alloys having the compositions:

$Cu_{0.7}V_4Si_{13.5}B_9Fe_{bal}$ $Cu_{0.7}Cr_3Si_{13.5}B_9Fe_{bal}$ was rapidly quenched by a single chill roll method, forming a ribbon of amorphous alloy. The rapidly quenched alloys were heat treated as described in Example 1. A fine crystalline phase of grains having an average grain size of up to 1,000 Å was found nowhere in the heat treated alloys. The alloys had a coercive force in excess of 5 Oe.

It is thus evident that the copresence of Cr and V is essential for fine grains to develop.

EXAMPLE 4

The same amorphous alloy ribbon as used in the preparation of sample No. 3 in Example 1 was heat treated at 350° C. for one hour for embrittlement and then finely divided into particles having a diameter of 105 to 500 μm in a vibratory ball mill. The particles were formed with a coating of water glass and press molded into a compact at 480° C. and 10 t/cm² for one minute. The compact was heat treated as in Example 1, forming a powder compressed core having an outer diameter of 14 mm, an inner diameter of 10 mm, and a height of 3 mm. The alloy powder occupied 91% by volume of the core.

The powder compressed core was formed with a gap having a length of 0.8 mm and received in a casing on which a conductor wire was wound. The assembly was used as a choke coil for smoothing an output of a switching power supply. No beat was perceivable at the gap.

The powder compressed core had a magnetic permeability of 550 at 1 kHz.

The alloy powder of the core was observed under a transmission electron microscope to find that it contained a fine crystalline phase of grains having an average grain size of up to 1,000 Å.

EXAMPLE 5

The same amorphous alloy ribbon as used in the preparation of sample No. 5 in Example 1 was wound. The winding was dipped in an epoxy resin and the epoxy resin coating was thermoset. The winding was heat treated as in Example 1 to develop a fine crystalline phase, completing a wound core having an outer diameter of 14 mm, an inner diameter of 10 mm, and a height of 3 mm.

The wound core was formed with a gap having a length of 0.8 mm and received in a casing on which a conductor wire was wound. The assembly was used as a choke coil for smoothing an output of a switching power supply. No beat was perceivable at the gap.

The wound core had a magnetic permeability of 250 at 1 kHz, a coercive force of 0.2 Oe, and a saturation magnetic flux density of 10 kG.

The alloy ribbon of the wound core was observed under a transmission electron microscope to find that it contained a fine crystalline phase of grains having an average grain size of up to 1,000 Å.

EXAMPLE 6

A water atomized powder was prepared using a water atomizing apparatus as shown in FIG. 3. The starting alloy material had the same composition as sample No. 3 in Example 1.

The water atomized powder was flattened in a media agitating mill as shown in FIG. 4. The flattened powder was heat treated as in Example 1. The heat treated powder was observed under a transmission electron microscope to find that is possessed a fine crystalline phase of grains having an average grain size of up to 1,000 Å. The water atomized powder had a D50 of 12 μm, an average thickness of 0.1 μm, and an elongation (a/b) of 1.4. It is to be noted that the average thickness was measured using a scanning electron microscope for analysis, and D50 was measured using a light scattering particle counter.

A magnetic shield composition was prepared by blending the soft magnetic powder with the following binder, curing agent, and solvent.

| | Parts by weight |
|---|---|
| Binder | |
| Vinyl chloride-vinyl acetate copolymer (Eslek A, Sekisui Chemical K.K.) | 100 |
| Polyurethane (Nippolan 2304, Nihon Polyurethane K.K.), calculated as solids | 100 |
| Curing agent | |
| Polyisocyanate (Colonate HL, Nihon Polyurethane K.K.) | 10 |
| Solvent | |
| Methyl ethyl ketone | 850 |

The magnetic shield composition contained 80% by weight of the soft magnetic powder.

The magnetic shield composition was applied to a length of polyethylene terephthalate film of 75 μm thick to form a coating of 100 μm thick. The coated film was taken up in a roll form, which was heated at 60° C. for 60 minutes to cure the binder. The coated film was cut into sections which were used as shield plates.

The shield plate was measured for shielding ratio as follows. The shielding plate was placed on a magnet to determine a leakage magnetic flux $\phi$ at a position spaced 0.5 cm from the plate. The shielding ratio ($\phi/\phi 0$) was determined by dividing the leakage magnetic flux $\phi$ by the magnetic flux $\phi 0$ determined without the shielding plate. On measurement, the shield plate was bent to a radius of curvature of 70 mm for applying stresses. The shield plate had a shielding ratio of up to 0.02.

The magnetic shielding composition was measured for coercive force both before and after the binder was cured, finding no difference.

EXAMPLE 7

A melt of an alloy having the composition:

$$Cu_{0.5}Cr_{3.5}V_{4.5}Si_{13.5}B_{11}Fe_{bal}$$

was rapidly quenched by a single chill roll method to form a ribbon of amorphous alloy.

The amorphous alloy ribbon was wound into a toroidal shape having an outer diameter of 14 mm, an inner diameter of 8 mm, and a height of 10 mm. The wound shape was heat treated at 575° C. for one hour in a nitrogen gas atmosphere, obtaining a wound core. After the heat treatment, the ribbon was analyzed by X ray diffraction. A peak indicative of grains was evidently observed. To identify a fine crystalline phase, the structure was observed under a transmission electron microscope. It was found that the ribbon contained grains having an average grain size of up to 1,000 Å.

The wound core was measured for effective permeability $\mu e$ which is one of the most important factors when the core is applied to a common mode choke coil for a noise filter. The effective permeability $\mu e$ was 19,000 as measured at a frequency of 100 kHz under a magnetic field of 2 mOe. This value was not achieved by conventional Fe-base amorphous alloys, but only by sophisticated Co-base amorphous alloys.

The wound core had a saturation magnetic flux density Bs of 12 kG, which value was about 3 times that of ordinary Co-base amorphous alloys.

For comparison purposes, an Mn-Zn ferrite core and a wound core of Fe-base amorphous alloy were also measured for these properties. The results are shown in Table 4 together with the results of the wound core of the alloy of the invention.

TABLE 4

| | Bs (kG) | ue |
|---|---|---|
| Invention | 12 | 19,000 |
| Mn-Zn ferrite | 4.1 | 5,500 |
| Fe-base amorphous | 12 | 5,500 |

EXAMPLE 8

A ribbon of alloy having the composition:

$$Cu_{0.5}Cr_pV_qSi_{13.5}B_9Fe_{bal}$$

was measured for a magnetostriction constant λs, effective permeability μ at 100 kHz and 2 mOe, and saturation magnetic flux density Bs.

The results are shown in FIG. 1.

As seen from FIG. 1, the soft magnetic alloys of the invention have low magnetostriction constant and excellent magnetic properties.

Further soft magnetic alloys were prepared by adding Nb to the alloy compositions containing Cr and V used in Examples. They were measured for the same properties as in Examples, finding equivalent results.

EXAMPLE 9

A starting alloy material having the composition shown in Table 5 was melted and then rapidly quenched into a ribbon of amorphous alloy by a single chill roll method. The rapid quenching was carried out in air. The nozzle for injecting the alloy melt against the chill roll had lips defining an injection slit having a transverse distance of 0.5 mm. Argon gas was used to apply a pressure of 0.2 kgf/cm$^2$ to the alloy melt for injection purposes.

The alloy melt was continuously spun to determine the time passed until the nozzle was completely clogged. The results were evaluated according to the following criterion.

◎: 30 minutes or more
○: 10 to less than 30 minutes
×: less than 10 minutes

The amorphous alloy ribbon resulting from rapid quenching was heat treated at 470° to 550° C. for one hour in nitrogen gas to thereby create a fine crystalline phase, obtaining a soft magnetic ribbon sample of 22 μm thick and 3 mm wide. The sample was observed under a transmission electron microscope to find that the sample contained 80 to 90% of a fine crystalline phase of grains having an average grain size of up to 1,000 Å.

The sample was measured for a magnetostriction constant λs, tested for corrosion resistance, and determined for a variation in coercive force Hc by stress application.

The corrosion resistance test was carried out by dipping a sample in 5% sodium chloride water for 24 hours and observing the sample surface. The evaluation criterion is given below.

○: no change
Δ: partial rusting
×: substantial rusting
××: entire rusting

The variation in coercive force Hc was measured by winding a ribbon sample into a toroidal shape having an outer diameter of 14 mm, an inner diameter of 10 mm, and a height of 3 mm, and securing the ends to form a wound core. The coercive force Hc0 of this wound core was measured. Then stress was applied to the wound core by placing a weight of 500 grams thereon. The coercive force Hc1 of the stressed core was measured. A variation in coercive force is calculated as Hc1/Hc0.

The results are shown in Table 5.

TABLE 5

| Sample No. | Alloy composition (at %) Fe | Cu | Cr | V | Nb | Si | B | Nozzle clogging | λs ($\times 10^{-6}$) | Corrosion resistance | Hc variation (%) |
|---|---|---|---|---|---|---|---|---|---|---|---|
| 91 | 67.5 | 0.5 | 4.0 | 0.5 | | 14.5 | 13.0 | ○ | +0.5 | ○ | 1.1 |
| 92 | 67.5 | 0.5 | 4.0 | 1.0 | | 15.0 | 12.0 | ○ | +0.1 | ○ | 0.8 |
| 93 | 66.0 | 0.5 | 4.0 | 2.0 | | 15.5 | 12.0 | ○ | −0.1 | ○ | 0.1 |
| 94* | 73.0 | 1.0 | | | 3.0 | 13.0 | 10.0 | X | +4.0 | XX | 2.1 |
| 95 | 67.5 | 0.5 | 4.0 | 5.0 | | 15.0 | 8.0 | X | −0.1 | ○ | 0.9 |
| 96* | 73.0 | 1.0 | | | 3.0 | 15.0 | 8.0 | X | +1.9 | X | 1.7 |
| 97 | 67.5 | 0.5 | 4.0 | 5.0 | | 16.0 | 7.0 | X | −1.2 | ○ | 0.8 |
| 98* | 73.0 | 1.0 | | | 3.0 | 16.0 | 7.0 | X | +0.6 | X | 1.4 |

*comparison

As seen from Table 5, the soft magnetic alloys of formula (III) containing Cr and V have a low magnetostriction constant λs and high corrosion resistance. Nozzle clogging is substantially retarded by limiting the V content to 2.5 atom % or less.

EXAMPLE 10

The same amorphous alloy ribbon as used in the preparation of sample No. 93 in Example 9 was heat treated at 350° C. for one hour for embrittlement and then finely divided into particles having a diameter of 105 to 500 μm in a vibratory ball mill. The particles were formed with a coating of water glass and press molded into a compact at 480° C. and 10 t/cm$^2$ for one minute. The compact was heat treated as in Example 9, forming a powder compressed core having an outer diameter of 14 mm, an inner diameter of 10 mm, and a height of 3 mm. The alloy powder occupied 91% by volume of the core.

The powder compressed core was formed with a gap having a length of 0.8 mm and received in a casing on which a conductor wire was wound. The assembly was used as a choke coil for smoothing an output of a switching power supply. No beat was perceivable at the gap.

The powder compressed core had a magnetic permeability of 350 at 1 kHz.

The alloy powder of the core was observed under a transmission electron microscope to find that it contained 80 to 90% of a fine crystalline phase of grains having an average grain size of up to 1,000 Å.

EXAMPLE 11

The same amorphous alloy ribbon as used in the preparation of sample No. 92 in Example 9 was wound. The winding was heat treated as in Example 9 to develop a fine crystalline phase, forming a wound core having an outer diameter of 14 mm, an inner diameter of 10 mm, and a height of 3 mm. The wound core was completed by dipping it in an epoxy resin and thermosetting the epoxy resin coating.

The wound core was formed with a gap having a length of 0.8 mm and a conductor wire was wound thereon. The assembly was used as a choke coil for smoothing an output of a switching power supply. No beat was perceivable at the gap.

The wound core had a magnetic permeability of 250 at 1 kHz, a coercive force of 0.2 Oe, and a saturation magnetic flux density of 10 kG.

The alloy ribbon of the wound core was observed under a transmission electron microscope to find that it contained 80 to 90% of a fine crystalline phase of grains having an average grain size of up to 1,000 Å.

EXAMPLE 12

A water atomized powder was prepared using a water atomizing apparatus as shown in FIG. 3. The starting alloy material had the same composition as sample No. 93 in Example 9. The apparatus was equipped at the melting furnace bottom with a nozzle having an inner diameter of 2 mm and operated at an injection pressure of 0.2 kgf/cm$^2$. The alloy melt was atomized in an argon gas atmosphere containing less than 1% of oxygen.

The alloy melt was continuously atomized under the conditions without nozzle clogging over 30 minutes.

The water atomized powder was flattened in a media agitating mill as shown in FIG. 4. The flattened powder was heat treated as in Example 9. The heat treated powder was observed under a transmission electron microscope to find that it contained 80 to 90% of a fine crystalline phase of grains having an average grain size of up to 1,000 Å. The water atomized powder had a D50 of 12 μm, an average thickness of 0.1 μm, and an elongation (a/b) of 1.4. It is to be noted that the average thickness was measured using a scanning electron microscope for analysis, and D50 was measured using a light scattering particle counter.

A magnetic shield composition was prepared by blending the soft magnetic powder with the following binder, curing agent, and solvent.

| | Parts by weight |
|---|---|
| Binder | |
| Vinyl chloride-vinyl acetate copolymer (Eslek A, Sekisui Chemical K.K.) | 100 |
| Polyurethane (Nippolan 2304, Nihon Polyurethane K.K.), calculated as solids | 100 |
| Curing agent | |
| Polyisocyanate (Colonate HL, Nihon Polyurethane K.K.) | 10 |
| Solvent | |

-continued

| | Parts by weight |
|---|---|
| Methyl ethyl ketone | 850 |

The magnetic shield composition contained 80% by weight of the soft magnetic powder.

The magnetic shield composition was applied to a length of polyethylene terephthalate film of 75 μm thick to form a coating of 100 μm thick. The coated film was taken up in a roll form, which was heated at 60° C. for 60 minutes to cure the binder. The coated film was cut into sections which were used as shield plates.

The shield plate was measured for shielding ratio ($\phi/\phi 0$) by the same procedure as in Example 6. The shield plate had a shielding ratio of up to 0.02.

The magnetic shielding composition was measured for coercive force both before and after the binder was cured, finding no difference.

EXAMPLE 13

A melt of an alloy having the composition:

$Fe_{68.5}Cu_{0.5}Cr_{2.5}V_{1.0}Si_{13.5}B_{14.0}$ was rapidly quenched by a single chill roll method to form a ribbon of amorphous alloy.

The amorphous alloy ribbon was wound into a toroidal shape having an outer diameter of 14 mm, an inner diameter of 8 mm, and a height of 10 mm. The wound shape was heat treated at 510° C. for one hour in a nitrogen gas atmosphere, obtaining a wound core. After the heat treatment, the ribbon was analyzed by X ray diffraction. A peak indicative of grains was evidently observed. To identify a fine crystalline phase, the structure was observed under a transmission electron microscope. It was found that the ribbon contained 80 to 90% of a fine crystalline phase of grains having an average grain size of up to 1,000 Å.

The wound core was measured for effective permeability μe which is one of the most important factors when the core is applied to a common mode choke coil for a noise filter. The effective permeability μe was 19,000 as measured at a frequency of 100 kHz under a magnetic field of 2 mOe. This value was not achieved by conventional Fe-base amorphous alloys, but only by sophisticated Co-base amorphous alloys.

The wound core had a saturation magnetic flux density Bs of 12 kG, which value was about 3 times that of ordinary Co-base amorphous alloys.

For comparison purposes, an Mn-Zn ferrite core and a wound core of Fe-base amorphous alloy were also measured for these properties. The results are shown in Table 4 together with the results of the wound core of the alloy of the invention.

TABLE 6

| | Bs (kG) | ue |
|---|---|---|
| Invention | 12 | 19,000 |
| Mn-Zn ferrite | 4.1 | 5,500 |
| Fe-base amorphous | 12 | 5,500 |

EXAMPLE 14

A ribbon of alloy having the composition shown in Table 7 was prepared according to the foregoing examples and measured for a magnetostriction constant λs, an effective permeability μe at 100 kHz and 2 mOe, and saturation magnetic flux density Bs.

The results are shown in Table 7.

TABLE 7

| Wound core | Alloy composition (at %) | | | | | | | λ s | μe |
|---|---|---|---|---|---|---|---|---|---|
| No. | Fe | Cu | Cr | V | Mn | Si | B | ($\times 10^{-6}$) | f = 100 kHz |
| 101 | 69.0 | 0.5 | 2.0 | 1.0 | | 14.5 | 13.0 | +4.5 | 15300 |
| 102 | 68.0 | 0.5 | 3.0 | 1.0 | | 14.5 | 13.0 | +2.5 | 19400 |
| 103 | 66.5 | 0.5 | 5.0 | 0.5 | | 14.5 | 13.0 | −0.1 | 17600 |
| 104 | 71.0 | 0.5 | 0.5 | 0.5 | | 14.5 | 13.0 | +5.0 | 7500 |
| 105 | 69.0 | 0.5 | 0.5 | 2.5 | | 14.5 | 13.0 | +2.2 | 15300 |
| 106 | 69.5 | 0.5 | 2.0 | 1.5 | | 14.5 | 13.0 | +3.5 | 12700 |
| 107 | 70.0 | 0.5 | 3.0 | 0.5 | 0.5 | 14.5 | 13.0 | +3.1 | 12000 |
| 108 | 67.5 | 0.5 | 1.0 | 0.5 | 3.0 | 14.5 | 13.0 | +0.5 | 13500 |

As seen from Table 7, the soft magnetic alloys of formula (III) have low magnetostriction and excellent magnetic properties.

Each sample was observed under a transmission electron microscope to find that it contained 80 to 90% of a fine crystalline phase of grains having an average grain size of up to 1,000 Å.

EXAMPLE 15

A melt of an alloy having the composition:

$Fe_{69.5}Cu_{0.5}Cr_{1.5}V_{1}Si_{15.5}B_{12}$ was rapidly quenched by a single chill roll method to form a ribbon of amorphous alloy. The ribbon was heat treated for one hour in a nitrogen gas atmosphere. The heat treated ribbon was measured for an effective permeability μe at 100 kHz, saturation magnetostriction constant λs, and crystallinity.

Figure 2:
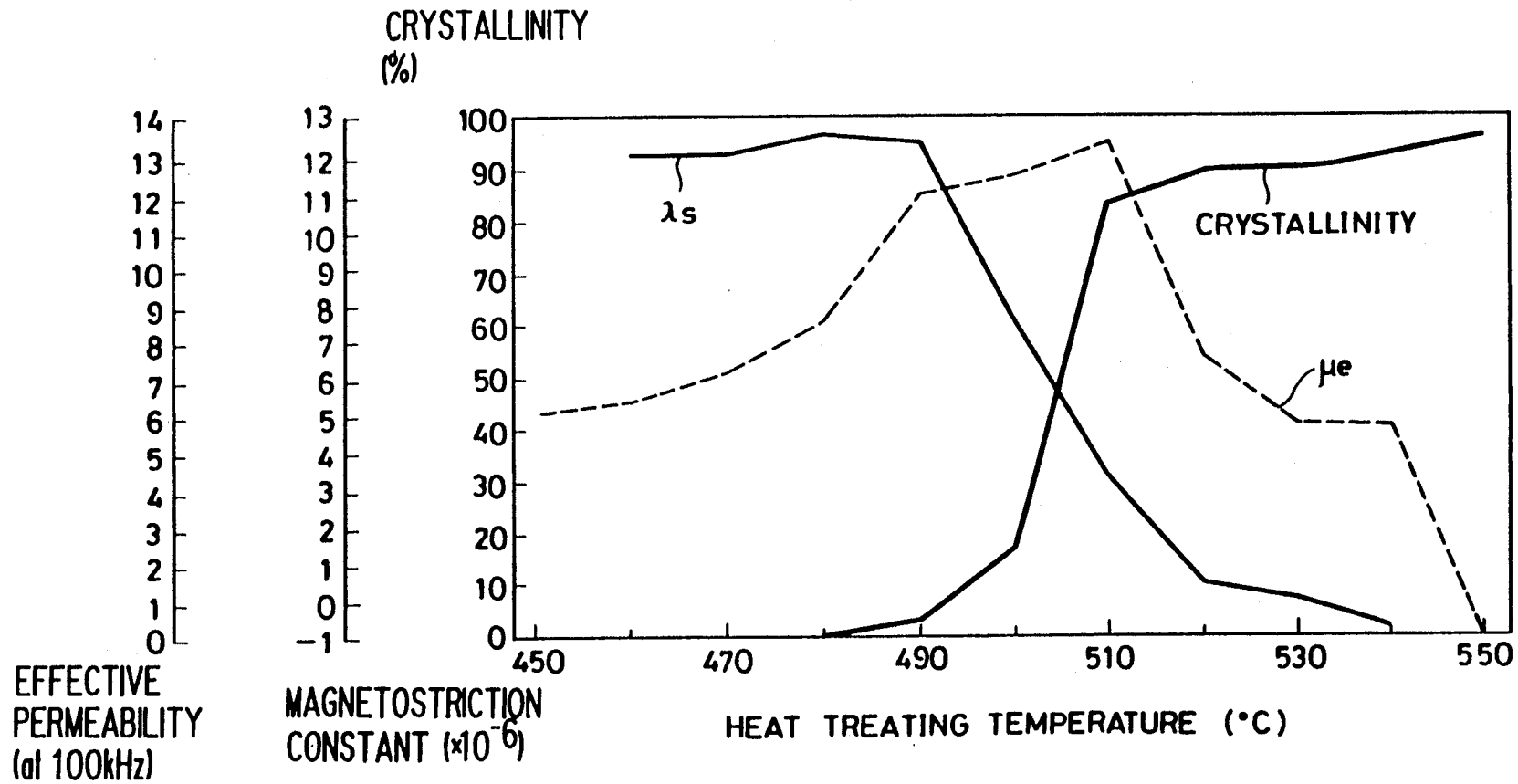
FIG. 2 is a diagram showing the effective permeability μe, saturation magnetostriction constant λs, and percent crystallinity of a soft magnetic alloy as a function of heat treating temperature.

These measurements are plotted relative to the heat treating temperature in FIG. 2. As seen from FIG. 2, the crystallinity is controllable so as to provide desired λs and μe by the heat treating temperature.

EXAMPLE 16

A melt of an alloy having the composition shown in Table 8 was rapidly quenched by a single chill roll method to form a ribbon of amorphous alloy.

The amorphous alloy ribbon was wound into a toroidal shape having an outer diameter of 14 mm, an inner diameter of 8 mm, and a height of 10 mm. The wound shape was heat treated at 495° C. for one hour in a nitrogen gas atmosphere, obtaining a wound core. After the heat treatment, the ribbon was analyzed by X ray diffraction. A peak indicative of grains was evidently observed. To identify a fine crystalline phase, the structure was observed under a transmission electron microscope. It was found that the ribbon contained grains having an average grain size of up to 1,000 Å.

The wound core was measured for effective permeability μe which is one of the most important factors when the core is applied to a common mode choke coil for a noise filter. The effective permeability μe was measured at a frequency of 100 kHz under a magnetic field of 2 mOe. The wound core was also measured for squareness ratio (Br/Bs).

The amorphous alloy ribbon from which the wound core was prepared was also subjected to the same heat treatment as done on the wound core. The ribbon having a fine crystalline phase developed was measured for saturation magnetostriction constant λs and squareness ratio.

The results are shown in Table 8.

TABLE 8

| Wound Core | Alloy composition (at %) | | | | | | | | λ s | Squareness | μe |
|---|---|---|---|---|---|---|---|---|---|---|---|
| No. | Fe | Cu | Cr | V | Mn | Nb | Si | B | ($\times 10^{-6}$) | ratio (%) | f = 100 kHz |
| 201 | 71.0 | 0.5 | 0.8 | 0.2 | | | 14.5 | 13.0 | +19 | 75.0 | 10200 |
| 202 | 70.0 | 0.5 | 1.8 | 0.2 | | | 14.5 | 13.0 | +11.3 | 77.0 | 10800 |
| 203 | 69.2 | 0.5 | 2.5 | 0.3 | | | 14.5 | 13.0 | +11 | 77.0 | 11000 |
| 204 | 71.0 | 0.5 | 0.5 | 0.5 | | | 14.5 | 13.0 | +16 | 52.0 | 10000 |
| 205 | 70.0 | 0.5 | 1.5 | 0.5 | | | 14.5 | 13.0 | +13.1 | 71.0 | 12500 |
| 206 | 71.0 | 0.5 | 0.2 | 0.8 | | | 14.5 | 13.0 | +15.6 | 67.0 | 12900 |
| 207 | 70.0 | 0.5 | 1.0 | 1.0 | | | 14.5 | 13.0 | +9.0 | 41.0 | 19900 |
| 208 | 69.2 | 0.5 | 1.8 | 1.0 | | | 14.5 | 13.0 | +8.3 | 61.0 | 13400 |
| 209 | 70.0 | 0.5 | 0.5 | 1.5 | | | 14.5 | 13.0 | +11 | 32.0 | 9800 |
| 210 | 70.0 | 0.5 | 0.2 | 1.8 | | | 14.5 | 13.0 | +10.2 | 32.0 | 9500 |
| 211 | 69.2 | 0.5 | 1.0 | 1.8 | | | 14.5 | 13.0 | +9.5 | 37.0 | 12300 |
| 212 | 69.2 | 0.5 | 0.3 | 2.5 | | | 14.5 | 13.0 | +9.1 | 32.0 | 9500 |
| 213 | 70.0 | 0.5 | 1.5 | 0.2 | 0.3 | | 14.5 | 13.0 | +10 | 53.0 | 11500 |
| 214 | 70.0 | 0.5 | 1.2 | 0.2 | 0.6 | | 14.5 | 13.0 | +8.5 | 45.0 | 13200 |
| 215* | 74.0 | 0.5 | | | | 3.0 | 13.5 | 9.0 | +2.2 | 86.0 | 6500 |

*comparison

As seen from Table 8, the soft magnetic alloys of formula (IV) containing at least 0.2 atom % of Cr and at least 0.2 atom % of V with a total content of Cr, V and Mn of less than 3 atom % have a low squareness ratio, high permeability, and high magnetostriction constant.

EXAMPLE 18

A melt of an alloy having the composition shown in Table 9 was rapidly quenched by a single chill roll method to form a ribbon of amorphous alloy. The amorphous alloy ribbon was passed through water glass or epoxy resin and then wound into a toroidal shape having an outer diameter of 14 mm, an inner diameter of 8 mm, and a height of 10 mm. The wound shape was heat treated at 510° C. for one hour in a nitrogen gas atmosphere, obtaining a wound core.

After the heat treatment, the ribbon was analyzed by X ray diffraction and observed under a transmission electron microscope. It was found that the ribbon contained a fine crystalline phase as in Example 17. It was also found that a coating of water glass or epoxy resin was formed on the ribbon surface.

A wound core was similarly prepared except that the ribbon was not passed through water glass or epoxy resin, and the heat treatment was carried out in air. In the resulting would core, an oxide film was formed on the ribbon surface.

These wound cores and the soft magnetic alloy ribbons from which the wound cores were prepared were measured for the same properties as in Example 17.

The results are shown in Table 9.

TABLE 9

| Wound core | Alloy composition (at %) | | | | | | | | | λ s | Squareness | μe |
|---|---|---|---|---|---|---|---|---|---|---|---|---|
| No. | Fe | Cu | Cr | V | Mn | Nb | Si | B | Coating | ($\times 10^{-6}$) | ratio (%) | f = 100 kHz |
| 301 | 70.7 | 0.5 | 0.8 | 0.5 | | | 15.5 | 12.0 | None | +13.1 | 72.0 | 13300 |
| 302 | 70.7 | 0.5 | 0.8 | 0.5 | | | 15.5 | 12.0 | Oxide | +13.1 | 18.0 | 11700 |
| 303 | 70.7 | 0.5 | 0.8 | 0.5 | | | 15.5 | 12.0 | Water glass | +13.1 | 7.3 | 11000 |
| 304 | 70.7 | 0.5 | 0.8 | 0.5 | | | 15.5 | 12.0 | Epoxy | +13.1 | 12.0 | 11300 |
| 305 | 69.3 | 0.7 | 1.0 | 0.5 | 0.5 | | 14.0 | 14.0 | None | +9.0 | 68.0 | 17000 |
| 306 | 69.3 | 0.7 | 1.0 | 0.5 | 0.5 | | 14.0 | 14.0 | Oxide | +9.0 | 20.0 | 12500 |
| 307 | 69.3 | 0.7 | 1.0 | 0.5 | 0.5 | | 14.0 | 14.0 | Water glass | +9.0 | 13.0 | 12300 |
| 308 | 69.3 | 0.7 | 1.0 | 0.5 | 0.5 | | 14.0 | 14.0 | Epoxy | +9.0 | 14.0 | 12300 |
| 309* | 73.5 | 1.0 | | | | 3.0 | 13.5 | 9.0 | None | +2.2 | 92.0 | 7400 |
| 310* | 73.5 | 1.0 | | | | 3.0 | 13.5 | 9.0 | Oxide | +2.2 | 87.0 | 7800 |
| 311* | 73.5 | 1.0 | | | | 3.0 | 13.5 | 9.0 | Water glass | +2.2 | 85.0 | 8500 |
| 312* | 73.5 | 1.0 | | | | 3.0 | 13.5 | 9.0 | Epoxy | +2.2 | 86.0 | 6500 |

*comparison

As seen from Table 9, the soft magnetic alloy ribbon having stresses applied by a coating formed on the surface thereof results in a wound core having a very low squareness ratio and high effective permeability.

EXAMPLE 19

The same amorphous alloy ribbon as used in the preparation of sample No. 208 in Example 17 was heat treated at 400° C. for one hour for embrittlement and then finely divided into particles having a diameter of 105 to 500 μm in a vibratory ball mill. The particles were formed with a coating of water glass and press molded into a compact at 510° C. and 10 t/cm$^2$ for one minute. The compact was heat treated at 510° C. for one hour, forming a powder compressed core having an outer diameter of 14 mm, an inner diameter of 10 mm, and a height of 3 mm. The alloy powder occupied 95% by volume of the core.

The powder compressed core was used as a choke coil for smoothing an output of a switching power supply. No beat was perceivable at the gap.

The powder compressed core had a magnetic permeability of 380 at 1 kHz.

The alloy powder of the core was observed under a transmission electron microscope to find that it contained a fine crystalline phase of grains having an average grain size of up to 1,000 Å.

The soft magnetic alloy of the composition of formula (I) or (II) containing Cr and V and/or Mn has low magnetostriction and high corrosion resistance.

The soft magnetic alloy of the composition of formula (III) promises efficient mass production and economy since this composition retards clogging of a nozzle for spinning an alloy melt therethrough when an amorphous alloy is first prepared.

The soft magnetic alloy of the composition of formula (IV) has a high permeability. When a stress applying coating is formed on the surface of a ribbon or particles of the soft magnetic alloy for applying stresses thereto, the ribbon or particles can be fabricated into a core having a high and constant permeability suitable for choke coils. Thus choke coil-forming magnetic cores having excellent magnetic properties can be manufactured in an efficient manner.

We claim:

1. A soft magnetic alloy having a composition in atomic ratio of general formula:

$$(Fe_{1-a}Ni_a)_{100-x-y-z-p-q}Cu_xSi_yB_zCr_pM^1{}_q \quad (I)$$

wherein $M^1$ is V or Mn or a mixture of V and Mn, and letters a, x, y, z, p, and q are in the following ranges:

$0 \leqq a \leqq 0.5$,
$0.1 \leqq x \leqq 5$,
$6 \leqq y \leqq 20$,
$6 \leqq z \leqq 20$,
$15 \leqq y+z \leqq 30$,
$0.5 \leqq p \leqq 10$, and
$0.5 \leqq q \leqq 10$, said soft magnetic alloy having a fine crystalline phase.

2. The soft magnetic alloy of claim 1 having a magnetostriction constant λs within the range of from $-5\times10^{-6}$ to $+5\times10^{-6}$.

3. A soft magnetic alloy having a composition of general formula:

$$(Fe_{1-a}Ni_a)_{100-x-y-z-p-q-r}Cu_xSi_yB_zCr_pM^1{}_qM^2{}_r \quad (II)$$

wherein $M^1$ is V or Mn or a mixture of V and Mn, $M^2$ is at least one element selected from the group consisting of Ti, Zr, Hf, Nb, Ta, Mo, and W, and letters a, x, y, z, p, q, and r are in the following ranges:

$0 \leqq a \leqq 0.5$,
$0.1 \leqq x \leqq 5$,
$6 \leqq y \leqq 20$,
$6 \leqq z \leqq 20$,
$15 \leqq y+z \leqq 30$,
$0.5 \leqq p \leqq 10$,
$0.5 \leqq q \leqq 10$, and
$0 \leqq r \leqq 10$, said soft magnetic alloy having a fine crystalline phase.

4. The soft magnetic alloy of claim 3 having a magnetostriction constant λs within the range of from $-5\times10^{-6}$ to $+5\times10^{-6}$.

5. A soft magnetic alloy having a composition in atomic ratio of general formula:

$$(Fe_{1-a}Ni_a)_{100-x-y-z-p-q-r}Cu_xSi_yB_zCr_pV_qMn_r \quad (III)$$

wherein letters a, x, y, z, p, q, and r are in the following ranges, $0 \leqq a \leqq 0.5$,
$0.1 \leqq x \leqq 5$,
$6 \leqq y \leqq 20$,
$6 \leqq z \leqq 20$,
$15 \leqq y+z \leqq 30$,
$0.5 \leqq p \leqq 10$,
$0.5 \leqq q \leqq 2.5$,
$0 \leqq r$, and
$3 \leqq p+q+r \leqq 12.5$ said soft magnetic alloy having a fine crystalline phase.

6. The soft magnetic alloy of claim 5 having a magnetostriction constant λs within the range of from $-5\times10^{-6}$ to $+5\times10^{-6}$.

7. The soft magnetic alloy of claim 5 containing 0.1 to 95% of a fine crystalline phase.

* * * * *